US009392667B2

(12) United States Patent
Lee et al.

(10) Patent No.: US 9,392,667 B2
(45) Date of Patent: Jul. 12, 2016

(54) BACKLIGHT UNIT, DISPLAY APPARATUS INCLUDING THE BACKLIGHT UNIT AND OPERATING METHOD THEREOF

(71) Applicant: SAMSUNG ELECTRONICS CO., LTD., Suwon-si (KR)

(72) Inventors: Jin-hyung Lee, Anyang-si (KR); Gil-yong Chang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 14/511,620

(22) Filed: Oct. 10, 2014

(65) Prior Publication Data

US 2015/0271893 A1 Sep. 24, 2015

(30) Foreign Application Priority Data

Mar. 20, 2014 (KR) ..... 10-2014-0032496

(51) Int. Cl.
*H05B 33/08* (2006.01)
*G09G 3/34* (2006.01)
*G09G 3/36* (2006.01)

(52) U.S. Cl.
CPC ..... *H05B 33/0887* (2013.01); *G09G 3/3406* (2013.01); *G09G 3/36* (2013.01); *H05B 33/0845* (2013.01); *G09G 2330/08* (2013.01); *G09G 2330/12* (2013.01)

(58) Field of Classification Search
CPC ..... H05B 33/0887; H05B 33/0845; H05B 33/0833; H05B 33/0875; G09G 3/3406; G09G 3/36
USPC ..... 315/186
See application file for complete search history.

(56) References Cited

U.S. PATENT DOCUMENTS

2011/0227503 A1* 9/2011 Yuan ..... G09G 3/3406 315/294
2012/0074856 A1* 3/2012 Takata ..... H05B 33/0815 315/192
2012/0299484 A1* 11/2012 Shin ..... H05B 33/0866 315/122
2012/0313536 A1* 12/2012 Kim ..... H05B 33/0818 315/186
2013/0082624 A1* 4/2013 Brassfield ..... H05B 33/0818 315/297
2014/0252965 A1* 9/2014 Pope ..... H02M 3/04 315/185 R
2014/0368129 A1* 12/2014 Fukuda ..... H05B 33/0818 315/297

* cited by examiner

*Primary Examiner* — Dylan White
(74) *Attorney, Agent, or Firm* — Sughrue Mion, PLLC

(57) ABSTRACT

A backlight unit, the backlight unit including a light-emitting diode (LED) module; a switching element connected to the LED module; and a controller configured to supply a driving voltage to the LED module, control a switching operation of the switching element, provide a constant current to the LED module, sense an operational error in the switching element, and control the driving voltage of the LED module in response to the sensed operational error.

11 Claims, 6 Drawing Sheets

BACKLIGHT UNIT, DISPLAY APPARATUS INCLUDING THE BACKLIGHT UNIT AND OPERATING METHOD THEREOF

CROSS-REFERENCE TO RELATED APPLICATIONS

This application claims priority from Korean Patent Application No. 10-2014-0032496 filed in the Korean Intellectual Property Office on Mar. 20, 2014, the disclosure of which is incorporated herein by reference in its entirety.

BACKGROUND

1. Field

Methods and apparatuses consistent with one or more exemplary embodiments relate to a backlight unit, a display apparatus including the backlight unit, and an operating method thereof, and more particularly, to a backlight unit being driven in a buck type, a display apparatus including the backlight unit, and an operating method thereof.

2. Description of the Related Art

With the development of information processing technologies, display technologies for displaying information are also developing at a rapid pace. Due to such development of display technologies, demand for existing CRT (Cathode-Ray Tube) decreased significantly, and demand for flat panel displays such as LCDs (Liquid Crystal Display) increased significantly.

In general, an LCD uses changes in transmittance of liquid crystal according to a voltage applied to a panel, thereby transmitting a light generated from a light source of a rear surface and providing an image to a user. That is, an LCD is not capable of self-luminescence and thus requires a separate backlight that is a light source.

Especially, an LED (Light Emitting Diode, hereinafter referred to as 'LED') is being actively adopted as a backlight source, such as for LCD panels etc. since it is environmentally friendly, has a response speed of within a several nanoseconds thus being capable of high speed response, and has a long life span.

Meanwhile, in order to utilize an LED as a backlight of a display apparatus, there exists various types of driving circuits that controls an operation of the LED. Conventional LED driving circuits that are widely used may be classified into boost type driving circuits and buck type driving circuits.

Of these, buck type LED driving circuits are circuits where output voltages are configured to be smaller than input voltages. As a buck type LED driving circuit, a buck converter that has an inductor, switching element, and freewheeling diode may be used. In such a case, when a defect occurs such as a short in a switching element, a problem may occur in the LED module that provides backlight to the display panel as well.

SUMMARY

According to one or more exemplary embodiments, there is provided a backlight protecting a light-emitting diode (LED) module in response to an error occurring in a switching element of a buck type converter, a display apparatus and driving method thereof.

According to one or more exemplary embodiments, there is provided a backlight unit including a light-emitting diode (LED) module; a switching element connected to the LED module; and a controller configured to supply a driving voltage to the LED module, control a switching operation of the switching element, provide a constant current to the LED module, sense an operational error in the switching element, and, in response to the sensing the operational error control the driving voltage of the LED module.

The controller may include a power supply configured to supply the driving voltage to the LED module; and an LED driver including a terminal, the LED driver configured to control the switching element, provide a constant current to the LED module, and transmit, in response to the operational error being sensed, an operational error signal to the power supply through the terminal provided in the LED driver.

The controller may further include a transmission element disposed between the power supply and the LED driver, and configured to transmit the operational error signal to the power supply in response to an input at or above a predetermined voltage.

The terminal of the LED driver may be configured to, in response to an operational error occurring in the switching element, transmit the operational error signal to the power supply and to receive a dimming signal.

The controller may further include a resistance for sensing an operational error of the switching element, and the LED driver may be further configured to measure a current of the resistance and, in response to the measured current amount exceeding a predetermined current amount, determine that the operational error occurred in the switching element.

The switching element may be an FET (Filed Effect Transistor) element.

According to one or more exemplary embodiments, there is provided a display apparatus including a display panel; an LED module configured to provide backlight to the display panel; and a controller configured to provide a driving voltage to the LED module, control a switching operation of a switching element connected to the LED module, provide a constant current to the LED module, sense an operational error occurring in the switching element, and control, in response to the operational error being sensed, the driving voltage of the LED module.

The controller may include a power supply configured to supply the driving voltage to the LED module; and an LED driver including a terminal, the LED driver configured to control the switching element, provide a constant current to the LED module, and, in response to the operational error being sensed, transmit an operational error signal to the power supply through the terminal provided in the LED driver.

The controller may further include a transmission element disposed between the power supply and the LED driver, wherein the transmission element is configured to transmit the operational error signal to the power supply in response to an input at or above a predetermined voltage.

The terminal of the LED driver may be configured to, in response to the operational error being sensed, transmit the operational error signal to the power supply and to receive a dimming signal.

The controller may further include a resistance for sensing an operational error of the switching element, and the LED driver may measure a current of the resistance and determine, in response to the measured current amount exceeding the predetermined current amount, that the operational error occurred in the switching element.

The switching element may be an FET (Filed Effect Transistor) element.

According to one or more exemplary embodiments, there is provided a backlight driving method of a display apparatus including a display panel, an LED module configured to provide backlight to the display panel, and a switching element connected to the LED module, the backlight driving method including supplying a driving voltage to the LED module; and controlling, in response to an operational error in the switching element being sensed, the driving voltage of the LED module.

The switching element may be an FET (Filed Effect Transistor) element.

The controlling the driving voltage of the LED module may include reducing, in response to the sensing of the operational error, the driving voltage of the LED module.

According to one or more exemplary embodiments, there is provided a backlight unit including a light-emitting diode (LED) module; a switching element connected to the LED module; and a controller configured to control a switching operation of the switching element, sense an operational error in the switching element, and transmit, in response to sensing the operational error in the switching element, an operational error signal to a power source of the LED module.

The backlight unit may further include a transmission element electrically connected between the power source and the controller, the transmission element configured to allow the transmission of the operational error signal to the power source.

The transmission element may be further configured to enable a transmission of a dimming signal to the controller.

The transmission element may be a Zener diode.

The controller may be further configured to reduce the driving voltage of the LED module in response to sensing the operational error.

According to the various exemplary embodiments, in response to an error occurring in the switching element of the buck type converter, it is possible to protect the LED module and increase the efficiency and economical feasibility of the apparatus.

BRIEF DESCRIPTION OF THE DRAWINGS

The above and/or other aspects will be more apparent by describing certain exemplary embodiments with reference to the accompanying drawings, in which.

DETAILED DESCRIPTION

Figure 1:
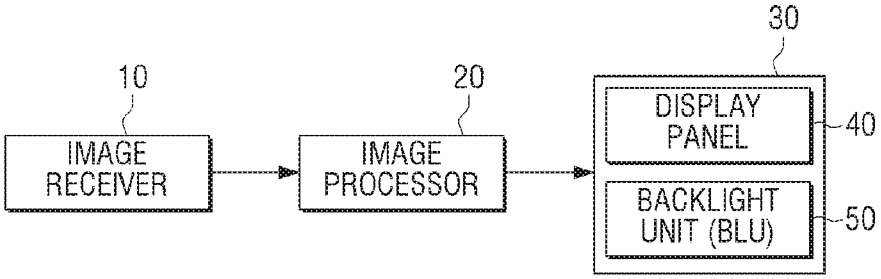
FIG. 1 is a block diagram illustrating a configuration of a display apparatus to which an exemplary embodiment.

Certain exemplary embodiments are described in higher detail below with reference to the accompanying drawings.

In the following description, like drawing reference numerals are used for the like elements, even in different drawings. The matters defined in the description, such as detailed construction and elements, are provided to assist in a comprehensive understanding of one or more exemplary embodiments. However, exemplary embodiments may be practiced without those specifically defined matters. Also, well-known functions or structures are not described in detail since they would obscure the application with unnecessary detail.

FIG. 1 is a block diagram illustrating a configuration of a display apparatus according to an exemplary embodiment.

As illustrated in FIG. 1, a display apparatus according to an embodiment of the present invention includes an image receiver 10, image processor 20, and display module 30. Meanwhile, the display module 30 includes a display panel 40 and a BLU (backlight unit, 50).

The image receiver 10 receives an image signal from an external source (not shown). Receiving an image signal may be made wirelessly or through a connection, such as through a DVD player or a Set Top Box (not shown). Alternatively or additionally, the image receiver 10 may receive an image signal from an internal source, such as a storage (not shown).

The image processor 20 performs signal processing such as video decoding, video scaling, and FRC (Frame Rate Conversion) regarding image contents being output from the image receiver 10.

The display module 30 displays a signal being output from the image processor 20, and the display panel 40 displays the image contents that have been signal processed in the image processor 20. Meanwhile, the backlight unit 50 projects backlight to the display panel 40 and enables the user to see the image displayed on the display panel 40.

Figure 2:
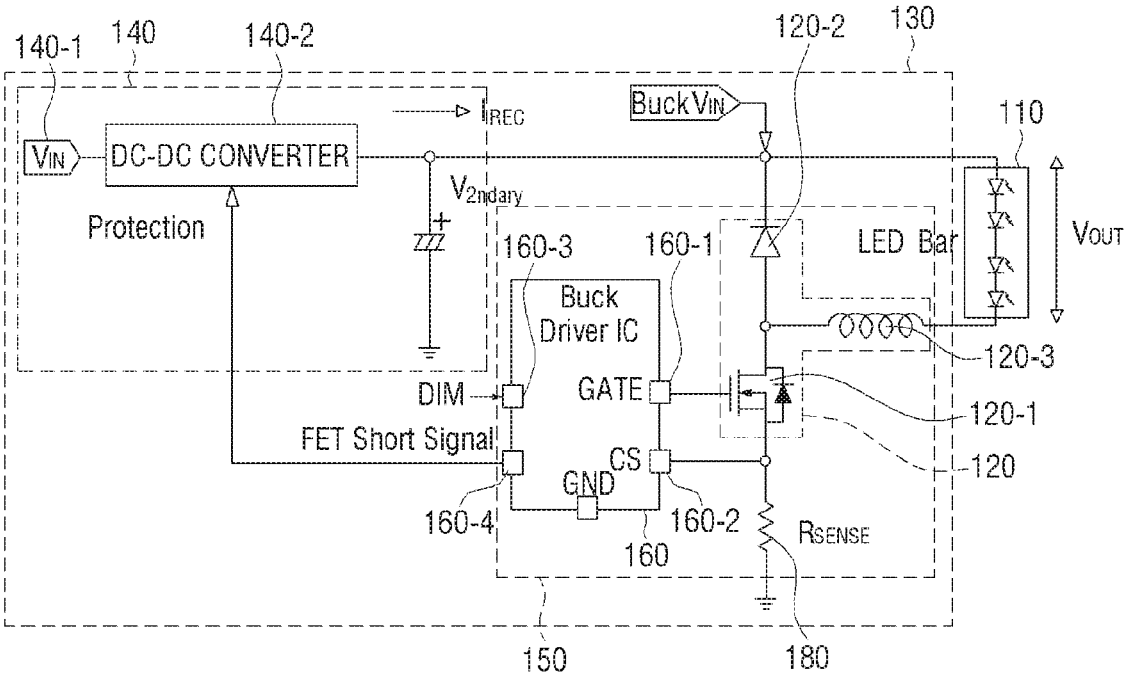
FIG. 2 is a circuit diagram of a backlight unit according to an exemplary embodiment.

FIG. 2 is a circuit diagram of a backlight unit according to an exemplary embodiment.

According to FIG. 2, the backlight unit may include an LED module 110, buck converter 120, and controller 130.

The backlight unit is a unit that projects backlight to the display panel 40 and enables the user to see the image displayed on the display panel 40.

The LED module 110 illuminates backlight to the display panel. More specifically, at least one LED is connected to the LED module 110 on a PCB (Printed Circuit Board), and the LED module 110 may illuminate a backlight to the display panel 40 according to the driving voltage applied from the controller 130. Herein, the brightness of the LED module 110 may be determined by an average value of the current that flows in the LED module 110. The LED module 110 may be embodied in the form of at least one LED array. An LED array means a bundle of series of LED that include a plurality of LEDs.

The buck converter 120 may be embodied in an element such as a transistor 120-1, diode 120-2, capacitor, inductor 120-3, etc. In such a buck converter, the transistor may be switched in a certain cycle according to an PWM (Pulse Width Modulator) signal received from outside and drive the LED. The buck converter 120 is generally used in a buck type backlight unit. A buck input voltage (BuckVin) is applied to the buck converter 120. A voltage may be applied from a gate end 160-1 of a buck driver IC (integrated circuit).

The controller 130 controls overall operations of the buck type backlight unit. The controller 130 may include a power supply 140 that supplies power to the LED module 110, and an LED driver 150 that provides constant current to the LED module. The controller 130 may control overall operations of the backlight unit so that constant current flows in the LED module 110. The controller 130 may supply a driving voltage to the LED module in a buck type, and may control switching operations of the switching element 120-1 of the buck converter 120. Herein, the buck type refers to when the input voltage is greater than the output voltage.

Of the configurative elements 120-1~3 of the buck converter 120, an FET 120-1 (Filed Effect Transistor) is generally used in the buck converter 120, and when the FET breaks, such as by a short etc., a problem may occur in the LED module 110 as well.

Meanwhile, the LED driver 150 may include a buck driver IC 160 and buck converter 120. The buck driver IC 160 is an element for controlling constant current in the LED module 110. The buck driver IC 160 may include a gate end 160-1, a CS (circuit sensing) end 160-2, a dimming signal end (DIM) 160-3, and an FET short signal transmission end 160-4. In the buck driver IC 160, a gate end 160-1 may be connected to a gate of the FET 120-1, and may transmit a signal to the LED module 110. The CS end 160-2 may sense a short of the FET 120-1. For example, the CS end 160-2 may measure the current of the resistor Rsense and sense a short of the FET 120-1. The sensing of the short of the FET 120-1 sensed through the CS end 160-2 is transmitted to the power supply 140 through the FET short signal transmission end 160-4 of the buck driver IC 160, and becomes capable of controlling the voltage flowing to the LED module. The dimming signal end 160-3 is a terminal where a dimming signal is input into the buck driver IC. A dimming signal may mean a signal that uses the duty ratio of the PWM (Pulse Width Modulator) signal to adjust the brightness, color, and temperature of the LED or perform temperature compensation.

The power supply 140 may include an input voltage end 140-1 and DC-DC (direct current to direct current) converter 140-2. The power supply 140 may supply an input voltage to a backlight unit. The DC-DC converter 140-2 may be configured in a flyback, LLC method, and may rectify the DC input voltage into an DC output voltage and supply it to the LED module 110.

When an operational error of the FET 120-1 is sensed, the LED driver 150 may transmit an operational error signal to the power supply 140 through the FET short signal transmission end 160-4 provided in the LED driver. That is, the LED driver 150 may sense failure of short of the FET 120-1, and transmit a corresponding signal to the power supply 140, thereby controlling the voltage that flows in the LED module 110. Accordingly, it becomes possible to protect the LED module, and improve the efficiency of the apparatus.

The controller 130 may further include a resistance 180 for sensing an operational error of the FET element 120-1. The LED driver 150 may measure a current amount of the resistance 180, and if the measured current amount exceeds a predetermined current amount, determine that an operational error occurred in the FET element 120-1. Detailed explanation will be made hereinafter.

Figure 3:
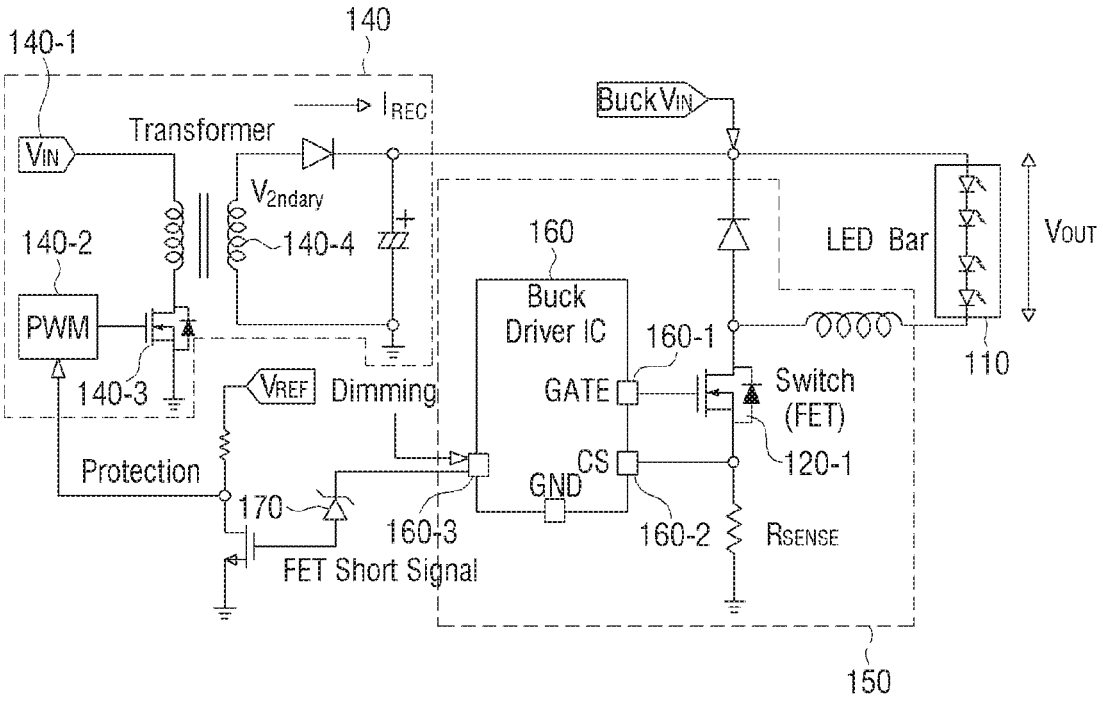
FIG. 3 is a circuit diagram of a backlight unit according to an exemplary embodiment.

FIG. 3 illustrates a circuit diagram of a backlight unit according to another exemplary embodiment.

While the LED driver 150 illustrated in FIG. 2 has a separate FET short signal transmission end 160-4 and transmits an FET short signal to the power supply 140 through the FET short signal transmission end 160-4, the LED driver 150 of FIG. 3 may perform FET short signal transmission through a dimming end or an analogue dimming end 160-3 that performs other functions.

Figure 5:
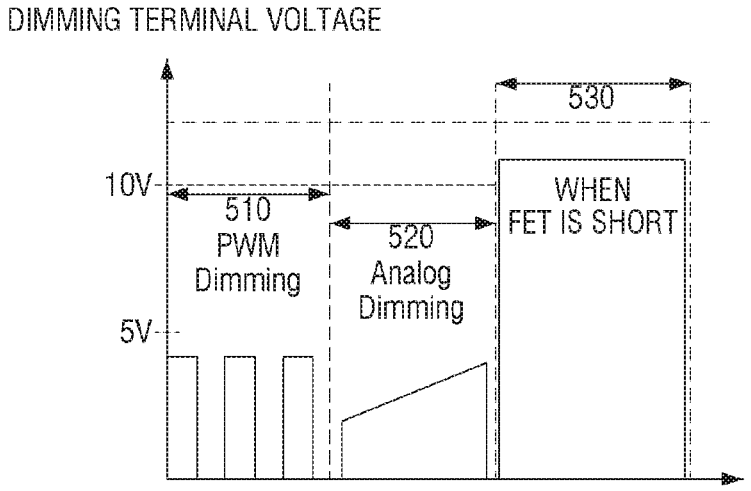
FIG. 5 is a view illustrating a waveform per operational condition in response to an FET short signal transmission function being added to a terminal of an LED driver IC.

More specifically, a first element 170, such as a transmission element, may be disposed between the power supply 140 and buck driver IC 160. The first element 170 may consist of a Zener diode. The first element 170 may operate at or above a predetermined voltage. Operations thereof will be explained with reference to FIG. 5. FIG. 5 is a view illustrating a waveform per operational condition, when an FET short signal transmission function is added to the dimming terminal 160-3 of the LED driver IC of FIG. 3.

According to FIG. 5, a first section 510 is a section for displaying the voltage of PWM Dimming, a second section 520 is a section for displaying the voltage of Analog Dimming, and a third section 530 is a section for displaying the voltage during an FET short.

When the FET 120-1 of the backlight unit is in a normal operation mode where a short does not occur, a PWM Dimming (510) or Analog Dimming (520) of 5V or below may be input to perform a corresponding function. However, when a short occurs in the FET 120-1 (530), 10V or more voltage may be applied to the dimming terminal 160-3, and, when a corresponding voltage is applied to the first element (for example a Zener diode 170 of FIG. 3), the FET short signal may be transmitted to the power supply 140. In one or more exemplary embodiments, it is explained that a terminal for a PWM Dimming and an Analog Dimming is jointly used as an FET short signal transmission terminal of a backlight unit, but this is merely an embodiment, and various terminals may be jointly used as an FET short signal transmission terminal.

Referring to FIG. 3 again, the power supply 140 may include an input voltage terminal 140-1, a pulse width modified power supply (PWM) 140-2, an FET 140-3, and a transformer. The corresponding power supply 140 may be configured in a flyback converter type. Furthermore, the CS end 160-2 of the buck driver IC may measure the current of Rsense and sense an FET short.

Furthermore, in response to an operational error occurring in the FET 120-1, FET short signal terminal 160-3 that is provided in the LED driver may be used in a first usage of transmitting an operational error signal to the power supply 140 and in a second usage where a dimming signal is input.

Figure 4A:
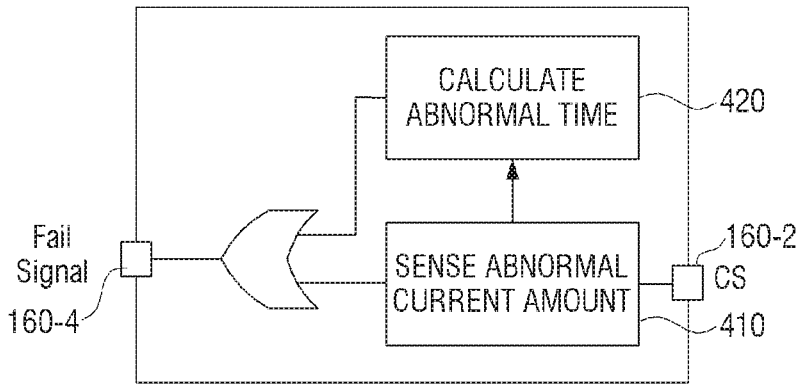
FIG. 4A and FIG. 4B are views illustrating an IC internal structure of an LED driver for FET short sensing according to an exemplary embodiment.
Figure 4B:
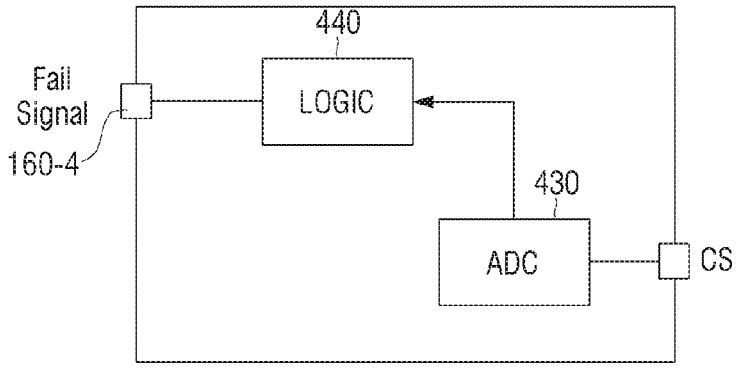

FIG. 4A and FIG. 4B are views illustrating an IC internal structure of an LED driver for FET short sensing according to an exemplary embodiment.

According to FIG. 4A, in the buck driver IC 160, the current of the FET 120-1 flows through the CS terminal 160-2. A sensor 410 may measure the current amount of the CS 160-2 terminal and sense the occurrence of the FET short. Then, an abnormal time calculator 420 may calculate the time of the abnormal current amount. The sensed abnormal sense current and abnormal time may be accumulated and the FET 120-1 short signal may be transmitted to the power supply 140.

According to FIG. 4B, inside the buck driver IC 160, the current of the FET 120-1 may flow through the CS terminal 160-2. Using the ADC (Analog-Digital Converter) 430 of the buck driver IC 160 and the logic necessary in generating an FET short signal, an FET 120-1 short signal may be generated and be transmitted to the power supply 140.

Figure 6:
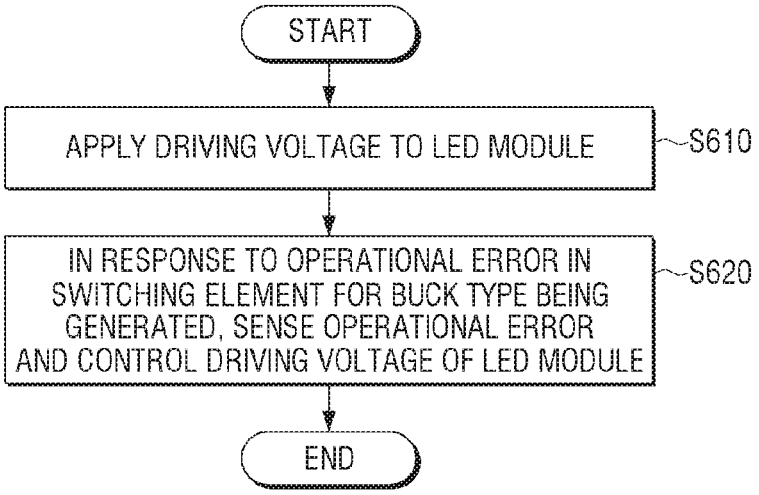
FIG. 6 is a flowchart of a backlight driving method of a display apparatus including an LED module that provides backlight to a display panel according to an exemplary embodiment.

FIG. 6 is a flowchart of a backlight driving method of a display apparatus including an LED module that provides backlight to a display panel according to an exemplary embodiment.

First, a driving voltage is applied to an LED module 110 (S610).

Next, when an operational error occurs in a switching element that is connected to the LED module and is used to supply a driving voltage in a buck type, the operational error is sensed and the driving voltage of the LED module is controlled (S620). In this case, the switching element may be an FET element.

In the present specification, it is explained that the display apparatus includes an image receiver 10, image processor 20, and display module 30, but all the configurative elements that are generally provided for driving a DTV may be included as configurative elements of the display apparatus.

Furthermore, in the present specification, it is explained that the FET element is the switching element 120-1 of the configurative elements 120-1~3 of the buck converter 120, but other switching elements may be used.

Furthermore, a display apparatus where a backlight unit according to an exemplary embodiment is applied may include a display panel, an LED module that provides backlight to the display panel, and a controller that applies a driving voltage in a buck type to the LED module and controls a switching operation of the switching element connected to the LED module, and provides constant current to the LED module. In this case, when an operational error occurs in the switching element, the controller may sense the operational error and control the driving voltage of the LED module. The controller may reduce the driving voltage of the LED module when the operational error is sensed.

In this case, the controller may further include a power supply that supplies voltage to the LED module, and an LED driver that controls the switching element connected to the controller and provides constant current to the LED module.

Herein, when an operational error occurs in the switching element, the LED driver may sense the operational error, and transmit an operational error signal to the power supply through a terminal provided in the LED driver.

Furthermore, the controller may further include a first element between the power supply and LED driver. The first element may transmit the operational error signal to the power supply only at or above a predetermined voltage. A Zener diode may be used as the first element.

Furthermore, when an operational error occurs in the switching element, the one terminal provided in the LED driver may be used for a first usage of transmitting an operational error signal to the power supply and a second usage where a dimming signal is input.

Furthermore, the controller may further include a resistance for sensing the switching element operational error. In this case, the LED driver may measure the current amount of the resistance, and if it exceeds the predetermined current amount, the LED driver may determine that an operational error occurred in the switching element. Herein, the switching element may be an FET element.

In a display panel and backlight driving method of a display apparatus including an LED module that provides backlight to the display panel according to various exemplary embodiments, when an operational error occurs in a switching element that is connected to the LED module and is used to supply a driving voltage in buck type, the step of sensing the operational error and controlling the driving voltage of the LED module may be encoded in software. Such software may be stored in a non-transitory computer readable medium and be used in an apparatus such as a display apparatus or glasses apparatus etc.

A non-transitory computer readable medium refers to a computer readable medium that may store data semi-permanently and not a medium that stores data for a short period of time such as a resister, cache, and memory etc. More specifically, the aforementioned programs may be stored and provided in a non-transitory computer readable medium such as a CD, DVD, hard disk, blueray disk, USB, memory card, and ROM etc. Although one or more exemplary embodiments have been shown and described, it would be appreciated by those skilled in the art that changes may be made in this embodiment without departing from the principles and spirit of the invention, the scope of which is defined in the claims and their equivalents.

What is claimed is:

1. A backlight unit comprising:

a light-emitting diode (LED) module;

a switching element connected to the LED module; and a controller configured to supply a driving voltage to the LED module, control a switching operation of the switching element, provide a constant current to the LED module, sense an operational error in the switching element, and in response to the sensing the operational error, control the driving voltage of the LED module, wherein the controller comprises:

a power supply configured to supply the driving voltage to the LED module;

an LED driver comprising a terminal, the LED driver configured to control the switching element, provide a constant current to the LED module, and transmit, in response to the operational error being sensed, an operational error signal to the power supply through the terminal provided in the LED driver; and a transmission element disposed between the power supply and the LED driver, and configured to transmit the operational error signal to the power supply in response to an input at or above a predetermined voltage, wherein the transmission element comprises a Zener diode.

2. The backlight unit according to claim 1, wherein the terminal of the LED driver is configured to, in response to an operational error occurring in the switching element, transmit the operational error signal to the power supply and to receive a dimming signal.

3. The backlight unit according to claim 1, wherein the controller further comprises a resistance for sensing an operational error of the switching element, and the LED driver is further configured to measure a current of the resistance and, in response to the measured current amount exceeding a predetermined current amount, determine that the operational error occurred in the switching element.

4. The backlight unit according to claim 1, wherein the switching element comprises a field effect transistor (FET) element.

5. A display apparatus comprising:

a display panel;

a light-emitting diode (LED) module configured to provide backlight to the display panel; and a controller configured to provide a driving voltage to the LED module, control a switching operation of a switching element connected to the LED module, provide a constant current to the LED module, sense an operational error in the switching element, and control, in response to the operational error being sensed, the driving voltage of the LED module, wherein the controller comprises:

a power supply configured to supply the driving voltage to the LED module;

an LED driver comprising a terminal, the LED driver configured to control the switching element, provide a constant current to the LED module, and transmit, in response to the operational error being sensed, an operational error signal to the power supply through the terminal provided in the LED driver; and a transmission element disposed between the power supply and the LED driver, wherein the transmission element is configured to transmit the operational error signal to the power supply in response to an input at or above a predetermined voltage, wherein the transmission element comprises a Zener diode.

6. The display apparatus according to claim 5, wherein the terminal of the LED driver is configured to, in response to the operational error being sensed, transmit the operational error signal to the power supply and to receive a dimming signal.

7. The display apparatus according to claim 5, wherein the controller further comprises a resistance for sensing an operational error of the switching element, and the LED driver is further configured to measure a current of the resistance and determine, in response to the measured current amount exceeding a predetermined current amount, that the operational error occurred in the switching element.

8. The display apparatus according to claim 5, wherein the switching element comprises a field effect transistor (FET) element.

9. A backlight unit comprising:

a light-emitting diode (LED) module;

a switching element connected to the LED module;

a controller configured to control a switching operation of the switching element, sense an operational error in the switching element, and transmit, in response to sensing the operational error in the switching element, an operational error signal to a power source of the LED module, and a transmission element electrically connected between the power source and the controller, the transmission element configured to allow the transmission of the operational error signal to the power source, wherein the transmission element comprises a Zener diode.

10. The backlight unit according to claim 9, wherein the transmission element is further configured to enable a transmission of a dimming signal to the controller.

11. The backlight unit according to claim 9, wherein the controller is further configured to reduce the driving voltage of the LED module in response to sensing the operational error.

* * * * *